US006227763B1

(12) United States Patent
Kuhns

(10) Patent No.: US 6,227,763 B1
(45) Date of Patent: May 8, 2001

(54) WATERWAY

(76) Inventor: Philip A. Kuhns, P.O. Box 127, Westmoreland, TN (US) 37186

( * ) Notice: Subject to any disclaimer, the term of this patent is extended or adjusted under 35 U.S.C. 154(b) by 0 days.

(21) Appl. No.: 09/342,874

(22) Filed: Jun. 29, 1999

(51) Int. Cl.[7] ..... E02B 11/00
(52) U.S. Cl. ..... 405/38; 405/43; 405/119
(58) Field of Search ..... 405/36, 38, 43, 405/118, 119, 127

(56) References Cited

U.S. PATENT DOCUMENTS

| | | | | |
|---|---|---|---|---|
| 856,702 | * | 6/1907 | Howley | 405/118 X |
| 938,204 | * | 10/1909 | Austin | 405/36 |
| 973,442 | * | 10/1910 | Lees | 405/118 |
| 1,363,690 | * | 2/1920 | Sullivan | 405/36 |
| 1,521,069 | | 12/1924 | Bern . | |
| 4,307,975 | | 12/1981 | Heitman . | |
| 4,561,801 | | 12/1985 | Nantz . | |
| 4,565,468 | * | 1/1986 | Crawford | 405/38 |
| 5,039,250 | | 8/1991 | Janz . | |
| 5,061,116 | | 10/1991 | Monks . | |
| 5,253,959 | * | 10/1993 | MacDonald et al. | 405/279 |
| 5,366,323 | | 11/1994 | Nicholson . | |
| 5,375,943 | | 12/1994 | McCavour et al. . | |

* cited by examiner

*Primary Examiner*—Roger Schoeppel
(74) *Attorney, Agent, or Firm*—Cook, Alex, McFarron, Manzo, Cummings & Mehler, Ltd.

(57) ABSTRACT

A waterway and system of waterways are disclosed in which the waterway includes a sheet of material having an upper face which defines a central channel straddled by a pair of skirts, and a pair of spaced walls between the channel and skirts to define the channel. When positioned in the system, the skirts of the waterway are anchored to the soil and covered with soil, and surface water from the soil is collected and drained through the channel. The ribs have walls which extend upwardly from the upper surface of the waterway, are spaced from each other and have juncture lines extending their length to permit the ribs and sheet of material to flex and rebound without damage when exposed to substantial loads.

29 Claims, 2 Drawing Sheets

WATERWAY

BACKGROUND AND SUMMARY OF THE INVENTION

The present invention is directed to a waterway and system for collecting and draining surface water and, more particularly, to an above ground waterway and system for collecting and draining such water.

A wide variety of equipment and systems have been employed in the past for the collection and drainage of surface water. These have included conventional drain tiles located both on and/or below the surface of the earth for the removal of undesirable or unwanted water from a specific location. Ditches and trenches or the like, both lined and/or unlined, have also been employed for this purpose.

The present invention is directed to a waterway and system of waterways for collecting and draining surface water which are simple and inexpensive to manufacture, transport and install, and are lightweight and easy to handle, but are immobile once installed. The waterways of the present invention may be anchored to the earth at the site at which water collection and drainage are desired, and are constructed to flex when loaded with loads, such as a vehicle driving over the waterway, without damage, and so as to rebound back to their original shape after the load has departed. Moreover, the waterway and system of the present invention are unobtrusive and minimize adverse, negative visual impact to the environment.

In one principal aspect of the present invention, a waterway and system for collecting and draining surface water comprises a sheet of material having an upper face, a pair of side edges and a pair of end edges, and at least one elongate skirt on the sheet of material which extends substantially between the end edges and adjacent to at least one of the side edges. A channel is on the sheet of material which also extends substantially between the end edges and substantially parallel to the side edges, and the channel collects and drains the water. A pair of ribs are spaced from each other and extend upwardly from the upper face of the sheet of material, and also extend substantially between the end edges and between the skirt and the channel, and the ribs define the channel.

In another principal aspect of the present invention, the ribs comprise a pair of walls which are spaced from each other, which extend upwardly from the upper face of the sheet of material, and which are joined to each other at their upper ends opposite the upper face.

In still another principal aspect of the present invention, each of the ribs includes at least one juncture line in their walls wherein the walls and/or portions of the walls extend in angular relationship to each other or to the upper face of the sheet of material, whereby the walls may flex and distort when loaded.

In still another principal aspect of the present invention, the sheet of material is formed of a semi-flexible polymer.

In still another principal aspect of the present invention, the skirt, channel and ribs are formed in one-piece relationship to each other.

In still another principal aspect of the present invention, the upper face of the sheet of material is substantially planar.

In still another principal aspect of the present invention, the sheet of material includes a pair of skirts each positioned on opposite sides of the ribs from the channel.

In still another principal aspect of the present invention, at least one reinforcing gusset is positioned between the ribs and the skirts.

In still another principal aspect of the present invention, anchoring means is provided for anchoring the skirt to the earth, and the anchoring means may comprise a screw extending through the skirt for screwing into the earth and/or a pin extending through the skirt for driving into the earth.

In still another principal aspect of the present invention, a rib extends across the channel between the spaced ribs.

In still another principal aspect of the present invention, at least two of the sheets of material are positioned in end to end relationship to each other with the respective skirts, ribs and channels of each sheet in longitudinal alignment with each other.

These and other objects, features and advantages of the present invention will be more clearly understood through a consideration of the following detailed description.

BRIEF DESCRIPTION OF THE DRAWINGS

In the course of this description reference will be frequently made to the attached drawings in which.

DESCRIPTION OF THE PREFERRED EMBODIMENTS

Figure 1:
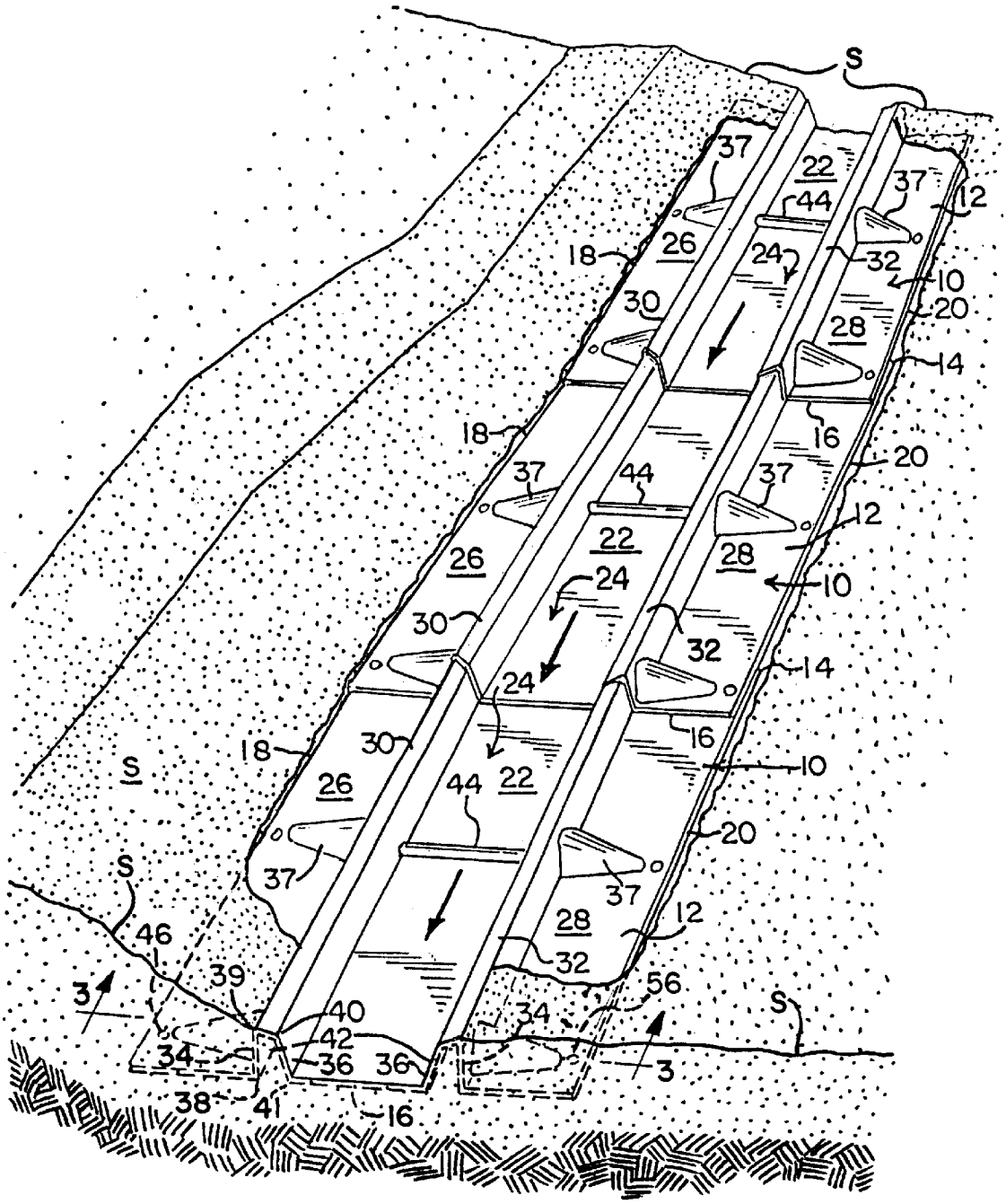
FIG. 1 is a partially broken, perspective view of a system for collecting and draining surface water and which includes a plurality of waterways of the present invention.

As seen in FIG. 1, a system is shown for the collection and draining of surface water which is constructed in accordance with the principles of the present invention. In the system of the invention, a plurality of waterways 10 are shown which are arranged in serial, longitudinally aligned, overlapping relationship to each other, preferably for conducting the surface water away from the site at which the system collects the water.

Each of the waterways 10 is preferably formed of a sheet of material 12 having opposite end edges 14 and 16, side edges 18 and 20, and an upper face 22. Each of the sheets of material 12 are preferably planar and arranged in consecutive longitudinally aligned fashion, as seen in FIG. 1, so that the end edges 16 of one sheet overlap the end edges 14 of the next adjacent sheet as seen in FIG. 1.

Each of the waterways 10 is divided into a channel 24 which is straddled by skirts 26 and 28. The channel 24 of each waterway is defined by and separated from the skirts 26 and 28 by a pair of longitudinally extending ribs 30 and 32 which are spaced from each other, as seen in the drawings. Each of the ribs 30 and 32 is preferably formed of a pair of spaced walls 34 and 36 which extend the length of the ribs. The bottoms of the walls 36 are fixed to the inner edges of the skirts 26 and 28, the bottoms of the walls 34 are fixed to the floor of the channel 24, and the tops of the respective walls 34 and 36 are fixed to each other to define the ribs 30 and 32 and channel 24. In addition, spaced gussets 37 are preferably spaced at intervals along the skirts 26 and 28. The gussets 37 abut the walls 34 of the ribs 30 and 32 to reinforce the ribs in use, and prevent excessive flexure of the ribs if subjected to exceptional loadings.

The sheet of material 12 from which the waterway of the invention is formed is preferably a semi-flexible, yet relatively hard and durable polymer. The polymer is preferably one which resists weathering and sunlight, considering the typical outdoor application of the present invention. The sheet of material 12 is preferably molded in one-piece form so that the ribs are integral to the channel floor 24 and skirts 26 and 28. Alternatively, the sheet of material 12 may be sheet metal.

Figures 2, 3, 4, 5, 6:
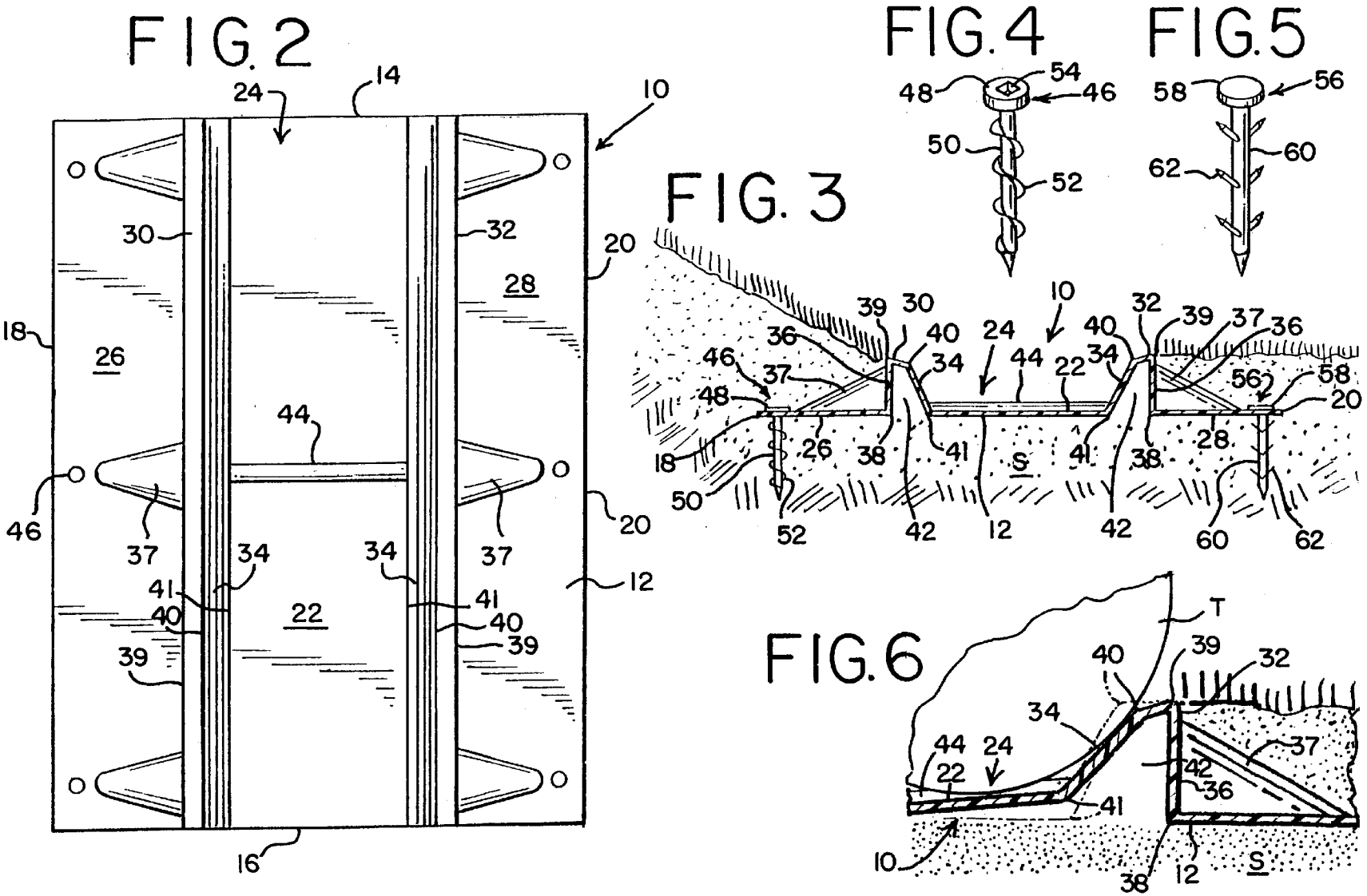
FIG. 2 is a plan view of one of the waterways of the present invention.
FIG. 3 is a cross-sectioned, end elevation view of one of the waterways of the system, as viewed substantially along line 3—3 of FIG. 1.
FIG. 4 is a perspective view of one embodiment of earth anchor for the waterways, as shown to the left in FIG. 3.
FIG. 5 is a perspective view of another embodiment of earth anchor for the waterways, as shown to the right in FIG. 3.
FIG. 6 is an enlarged, broken, cross-sectioned view of a portion of the waterway shown in FIG. 3, and showing the manner in which the waterway flexes when subjected to extensive loading.

An important feature of the invention is that the walls 34 and 36, either or both at their juncture line with themselves or with the channel 22 or skirts 26 and 28, extend angularly so as to form lines of flexure 38, 39, 40 and 41. These lines of flexure permit the ribs 30 and 32 and the sheet material to flex when exposed to substantial loads, such as being driven over by a vehicle tire T, as illustrated in FIG. 6. This is especially the case when considering the preferred semi-flexible nature of the material in the first instance. This permits the waterways to flex to absorb the impact of such loads without breaking, and then rebound to the original configuration once the load passes. Moreover, the spacing of the walls 34 and 36 of each of the respective ribs 30 and 32 from each other defines a void 42 beneath each of the ribs which preferably remains substantially unfilled with earth when the waterways are installed into the system of the invention. This void 42 provides space for the walls 34 and 36 to flex about their lines of flexure 38, 39, 40 and 41 without interference.

One or more ribs 44 may also be formed to extend transversely across the channels 24 between the inner walls 34 of the ribs 30 and 32. These transverse ribs 44 provide "speed bumps" to slow the flow of water being drained through the channel.

Upon initial installation, each of the waterways 10 is preferably anchored in its desired position and in adjoining aligned overlapping relationship to its next adjacent waterway by anchoring devices which anchor the waterways to the soil S. One such embodiment of anchoring device 46 is shown to the left in FIG. 3 and in perspective in FIG. 4. Anchoring device 46 preferably comprises a head 48 from which a longitudinal shaft 50 projects into the soil. The shaft 50 carries screw threads 52 for anchoring the anchor device 46 and its skirt 26 to the soil S. To facilitate installation, anchoring device 46 preferably includes a multi-sided recess 54 for receipt of an appropriate tool to rotate the screw threads 52.

An alternate embodiment of anchoring device 56 is shown to the right in FIG. 3 and in perspective in FIG. 5. Anchoring device 56 includes a relatively flat head 58 and a downwardly depending shaft 60 with V-pins 62 along its length for anchoring skirt 28 into the soil S. Anchoring device 56 is preferably driven into the soil and is held in the soil against removal by the V-pins 62.

It will be appreciated that either or both of the anchoring devices 46 or 56 may be alternatively employed to anchor the waterways 10 of the present invention either in combination or individually.

It will also be appreciated that other forms and designs of soil anchoring devices other than devices 46 and 56 as shown are known to the art and may be employed to anchor the waterways with equal effectiveness to the devices which have been shown and described by way of example.

In the system of the invention, the respective waterways 10 are assembled in serial longitudinally aligned fashion as best seen in FIG. 1, with their respective end edges 14 and 16 positioned in overlying relationship, and their respective channels 24, skirts 26 and 28 and ribs 30 and 32 in longitudinal alignment with each other. As the respective waterways are arranged in sequence, each is anchored into the soil S by one or more anchoring devices 46 and/or 56, as seen in FIG.1, and the soil S is backfilled over the skirts and up to the outer walls 36 of the ribs 30 and 32, as seen in FIG. 3. This further anchors the waterways in the soil and immobilizes them in place, and the water flows over the ribs and into the channel 24 of each of the waterways 10 where it is collected and drained in the direction of the shown in FIG. 1. This also minimizes any adverse negative visual impact or effect which the artificial waterways and systems of the invention may otherwise have on the environment.

It will be appreciated from the foregoing description, that the system and waterways of the present invention are simple and inexpensive to transport, install and manufacture, and they provide protection against damage from excessive loading once installed. Moreover, they are lightweight and easy to handle, but remain immobile once installed.

It also will be understood that the preferred embodiments of the present invention which have been described are merely illustrative of the principles of the present invention. Modifications may be made by those skilled in the art without departing from the true spirit and scope of the invention.

I claim:

1. A waterway for collecting and draining surface water comprising:

a sheet of material having an upper face, a pair of side edges and a pair of end edges;

at least one elongate skirt on the sheet of material, said skirt extending substantially between the end edges and adjacent to at least one of said side edges;

a channel on the sheet of material which also extends substantially between the end edges and substantially parallel to said side edges, said channel collecting and draining the water; and a pair of ribs spaced from each other and extending upwardly from said upper face, said ribs also extending substantially between said end edges and between said skirt and said channel and defining said channel, said ribs comprising a pair of walls which are spaced from each other, which extend upwardly from said upper face, and which are joined to each other at their upper ends opposite said upper face, and wherein each of said ribs includes at least one juncture line in said walls wherein said walls and/or portions of said walls extend in angular relationship to each other or to said upper face, whereby said walls may flex and distort when loaded.

2. The waterway of claim 1, wherein said sheet of material is formed of a semi-flexible polymer.

3. The waterway of claim 1, wherein said skirt, channel and ribs are formed in one-piece relationship to each other.

4. The waterway of claim 1, wherein said upper face of said sheet of material is substantially planar.

5. The waterway of claim 1, including a pair of skirts each on the opposite sides of said ribs from said channel.

6. The waterway of claim 1, including at least one reinforcing gusset between said rib and said skirt.

7. The waterway of claim 1, including anchoring means for anchoring said skirt to the earth.

8. The waterway of claim 7, wherein said anchoring means comprises a screw extending through said skirt for screwing into the earth.

9. The waterway of claim 7, wherein said anchoring means comprises a pin extending through said skirt for driving into the earth.

10. The waterway of claim 1 including, a pair of said skirts, each on the opposite sides of said ribs from said channel; wherein said sheet of material is formed of a semi-flexible polymer, whereas said skirts, channel and ribs are formed in one-piece relationship to each other; and wherein said upper face of said sheet of material is substantially planar.

11. The waterway of claim 10, including at least one reinforcing gusset between each of said ribs and their adjacent skirts.

12. The waterway of claim 10, including anchoring means for anchoring said skirt to the earth.

13. The waterway of claim 1, including a rib extending across said channel between said spaced ribs.

14. A system for collecting and draining surface water from the earth, comprising;

a sheet of material having an upper face, a pair of side edges, and a pair of end edges;

pair of elongate skirts on the sheet of material extending substantially between the end edges, each of said skirts being spaced from each other and positioned adjacent to each of said side edges, and being covered with earth;

a channel on the sheet between said skirts and also extending substantially between the end edges and substantially parallel to said side edges, said channel collecting and draining the water from the earth; and a pair of ribs spaced from each other and extending upwardly from said upper face, said ribs also extending substantially between said end edges and between said skirts and said channel, said ribs defining said channel and restraining the earth on said skirts from entering said channel.

15. The system of claim 14, wherein said ribs comprise a pair of walls which are spaced from each other, which extend upwardly from said upper face and which are joined to each other at their upper ends opposite said upper face.

16. The system of claim 15, wherein each of said ribs includes at least one juncture line in said walls wherein said walls and/or portions of said walls extend in angular relationship to each other or to said upper face, whereby said walls may flex and distort when loaded.

17. The system of claim 14, wherein said sheet of material is formed of a semi-flexible polymer.

18. The system of claim 14, wherein said skirts, channel and ribs are formed in one-piece relationship to each other.

19. The system of claim 14, wherein said upper face of said sheet of material is substantially planar.

20. The system of claim 14, including at least one reinforcing gusset between each of said ribs and their adjacent skirts.

21. The system of claim 14, including anchoring means for anchoring said skirts to the earth.

22. The system of claim 21, wherein said anchoring means comprises a screw extending through said skirt and screwed into the earth.

23. The system of claim 21, wherein said anchoring means comprises a pin extending through said skirt and driven into the earth.

24. The system of claim 14, wherein said ribs comprise a pair of walls which are spaced form each other, which extend upwardly from said upper face and which are joined to each other at their upper ends opposite said upper face, each of said ribs including at least one juncture line in said walls wherein said walls and/or portions of said walls extend in angular relationship to each other or to said upper face, whereby said walls may flex and distort when loaded; wherein said sheet of material is formed of a semi-flexible polymer, and said skirts, channel and ribs are formed in one-piece relationship to each other; and wherein said upper face of said sheet of material is substantially planar.

25. The system of claim 14, including at least one reinforcing gusset between each of said ribs and their adjacent skirts.

26. The system of claim 14, including anchoring means anchoring said skirt to the earth.

27. The system of claim 14, including a rib extending across said channel between said spaced ribs.

28. The system of claim 14, including at least two of said sheets of material positioned in end to end relationship to each other with the respective skirts, ribs and channels of each sheet in longitudinal alignment with each other.

29. The system of claim 28, wherein an end edge of one of said sheets of material overlays an end edge of the other of said sheets of material.

* * * * *

UNITED STATES PATENT AND TRADEMARK OFFICE

CERTIFICATE OF CORRECTION

PATENT NO. : 6,227,763 B1
DATED : May 8, 2001
INVENTOR(S) : Philip A. Kuhns

It is certified that error appears in the above-identified patent and that said Letters Patent is hereby corrected as shown below:

Title page,
Item [57] ABSTRACT,
Line 2, "includes" should be -- comprises --.

Column 4,
Line 16, before "shown" the word -- arrows -- should be inserted.

Column 6,
Line 41, "end to end" should be deleted.

Signed and Sealed this

Ninth Day of September, 2003

JAMES E. ROGAN
*Director of the United States Patent and Trademark Office*